US005604966A

United States Patent [19]

Morello et al.

[11] Patent Number: 5,604,966

[45] Date of Patent: Feb. 25, 1997

[54] SEAMING DEVICE CAPABLE OF JOINING CURVED AND STRAIGHT PANELS

[75] Inventors: Frederick Morello; Christopher K. Kastner, both of Johnstown, Pa.

[73] Assignee: M.I.C. Industries, Inc., Reston, Va.

[21] Appl. No.: 477,262

[22] Filed: Jun. 7, 1995

[51] Int. Cl.[6] ..... B23P 11/00

[52] U.S. Cl. ..... 29/243.58; 29/243.5

[58] Field of Search ..... 29/243.5, 243.55, 29/243.57, 243.58; 72/210, 211; 226/112, 108, 188, 189; 74/665 B

[56] References Cited

U.S. PATENT DOCUMENTS

| | | | |
|---|---|---|---|
| 3,473,715 | 10/1969 | Shuey, Jr. | 226/188 |
| 3,553,831 | 1/1971 | Palmer et al. | 29/243.5 |
| 4,033,496 | 7/1977 | Rolfe | 226/188 |
| 4,324,031 | 4/1982 | Isenhoff | 29/243.58 |
| 4,470,186 | 9/1984 | Knudson . | |
| 4,505,084 | 3/1985 | Knudson . | |
| 5,203,954 | 4/1993 | Moore | 156/574 |
| 5,249,445 | 10/1993 | Morello . | |

*Primary Examiner*—Bruce M. Kisliuk
*Assistant Examiner*—Lee D. Wilson
*Attorney, Agent, or Firm*—Rothwell, Figg, Ernst & Kurz

[57] ABSTRACT

A seaming device for connecting building panels in a continuous along adjacent side edges of two building panels in the construction of a building or light structure which is particularly suited for seaming panels with both curved and straight portions. The seaming device includes a first frame having an electric motor and two horizontally opposed rollers and a second portion having an electric motor and two horizontally opposed rollers with the first and second portions being coupled together in a hinge-like manner.

2 Claims, 8 Drawing Sheets

SEAMING DEVICE CAPABLE OF JOINING CURVED AND STRAIGHT PANELS

BACKGROUND OF THE INVENTION

1. Field of the Invention

The invention relates to a novel seam-forming apparatus for connecting building panels in a continuous seam along adjacent side edges of two building panels in the construction of a building or like structure.

2. Prior Art and Background

It is known to construct continuous arch metal buildings with adjacent curved building panels which are seamed together at their adjacent edges. Such a system is described, for example, in U.S. Pat. No. 4,505,084 and U.S. Pat. No. 5,249,445.

In connection with seaming panels for such metal buildings, seaming devices have been used. Such a device is disclosed, for example, in U.S. Pat. No. 4,470,186 which is hereby incorporated by reference as if fully set forth herein. The seaming device connects or seams together the side edge portions of adjacent panels.

An apparatus referred to as a panel machine produces structural panel members using a roll forming process such as described in U.S. Pat. No. 4,505,084. Incorporated in one edge of each panel is a hook portion and on the opposite edge is a hem portion. The hem portion is designed to fit underneath and inside of the hook portion of an adjacent panel resulting in an interlocking feature for joining the panels together. The panels themselves may be curved or straight and may have both straight and curved portions.

Past seamers have usually only been capable of seaming either straight panel portions or curved panel portions. Such seamers are not able to seam panels that are both straight and curved. When attempting to utilize such a seamer on panels with both curved and straight portions, the seaming apparatus tends to "walk off" or dislodge from the seam particularly in transition areas where the panel changes from straight to curved or vice versa. In addition, such seamers were prone to cause damage to the panel and the finish of the panel, particularly in the transition regions.

SUMMARY OF THE INVENTION

The seaming apparatus of the present invention includes two freestanding frames each of which includes a motor, a gear drive train, and a set of horizontal opposed rotatably mounted rollers. The two frames are coupled together in a hinge-like manner across the line of travel of the seamer. Each frame consists of two halves. The distance between the halves can be adjusted through the use of rails and a clamping screw. The hinge-like mounting between the two frames improves the ability of the apparatus to seam over transition areas where the panels change from straight to curved or vice versa.

The surfaces of the horizontally opposed rollers are shaped to cause the hook of one panel edge to fold tightly over the hem of the adjacent panel edge, creating a strong continuous seam. The rollers attached to one half of the frame are mounted using a quick release system to allow them to be easily removed and reinstalled to allow the apparatus to be reversed.

Other aspects, advantages and capabilities of the present invention will become apparent to those of ordinary skill in the art upon reviewing the following detailed description in conjunction with the accompanying drawings.

DETAILED DESCRIPTION OF THE PREFERRED EMBODIMENTS

Figure 1:
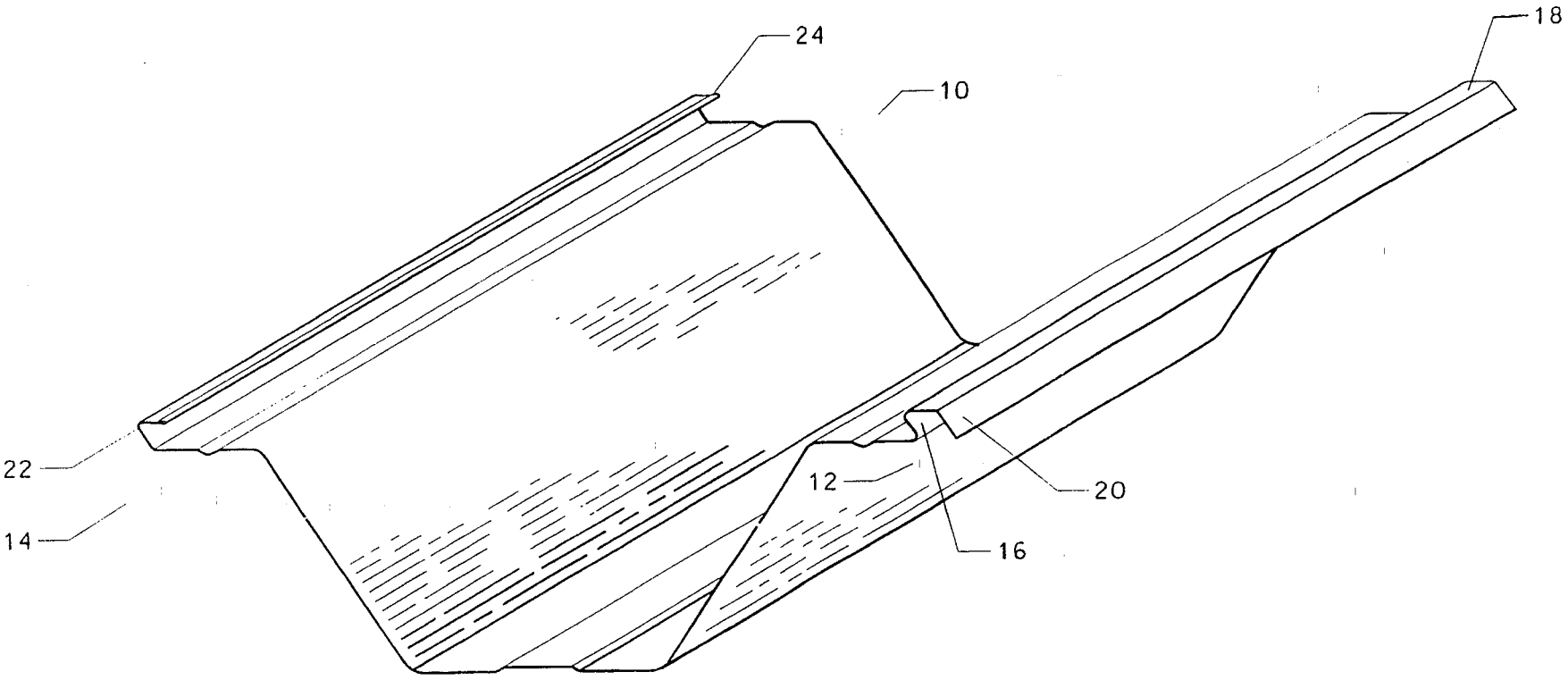
FIG. 1 is a perspective view of a structural panel.

FIG. 1 shows a perspective view of a structural panel of the type preferably joined or seamed by the present invention. The structural panel generally indicated as 10 includes a hook generally indicated as 12 and a hem generally indicated as 14. The hook is generally U-shaped and includes a vertical section 16, an out turned flange portion (horizontal portion) 18 and a down turned terminal portion (vertical edge) 20 which in combination form a U-shaped channel. The hem portion includes a vertical portion 22 and a top horizontal portion 24 that is doubled over at its edge and is placed within the U-shaped channel of the hook prior to the seaming operation. Generally speaking, the seaming process involves turning vertical edge 20 under top horizontal portion 24 to form a tight seam.

Referring now to FIGS. 2–8, a preferred embodiment of the seaming apparatus of the present invention is indicated generally as 26. The seaming apparatus is generally comprised of a first frame 28 and a second frame 30. Except where indicated otherwise, the first frame 28 and the second frame 30 are constructed in an identical manner. Each frame holds a reversible electric motor 32 and a gear drive train partially indicated at 34 and driven by the electric motor 32. Each frame further includes a set of horizontally opposing rollers driven by the gear drive train. The gear drive train of one frame is described below with it being understood by those of ordinary skill that the drive train of the other frame is identical.

Figure 6:
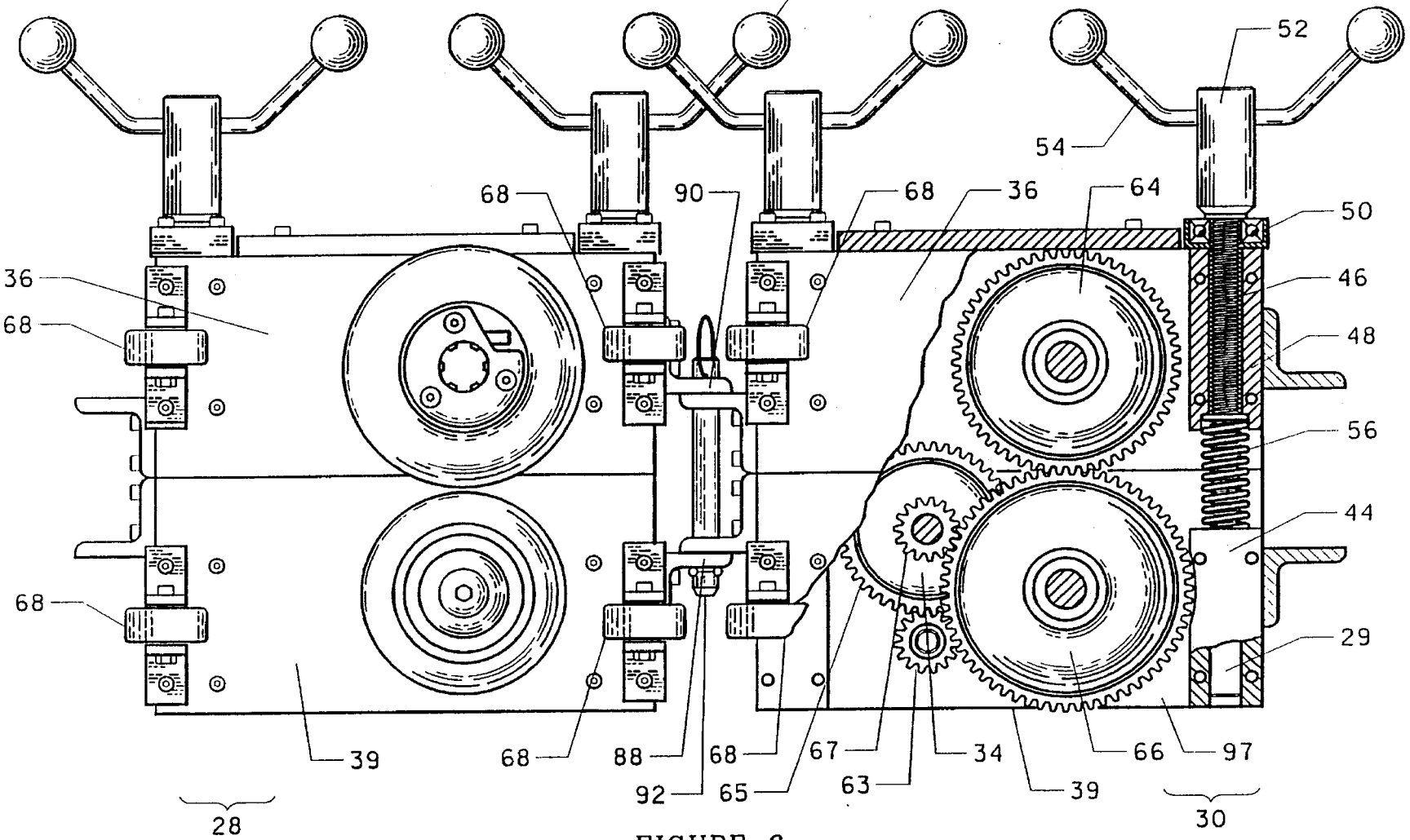
FIG. 6 is a partial cut-away bottom view of an embodiment of the present invention.
Figure 7:
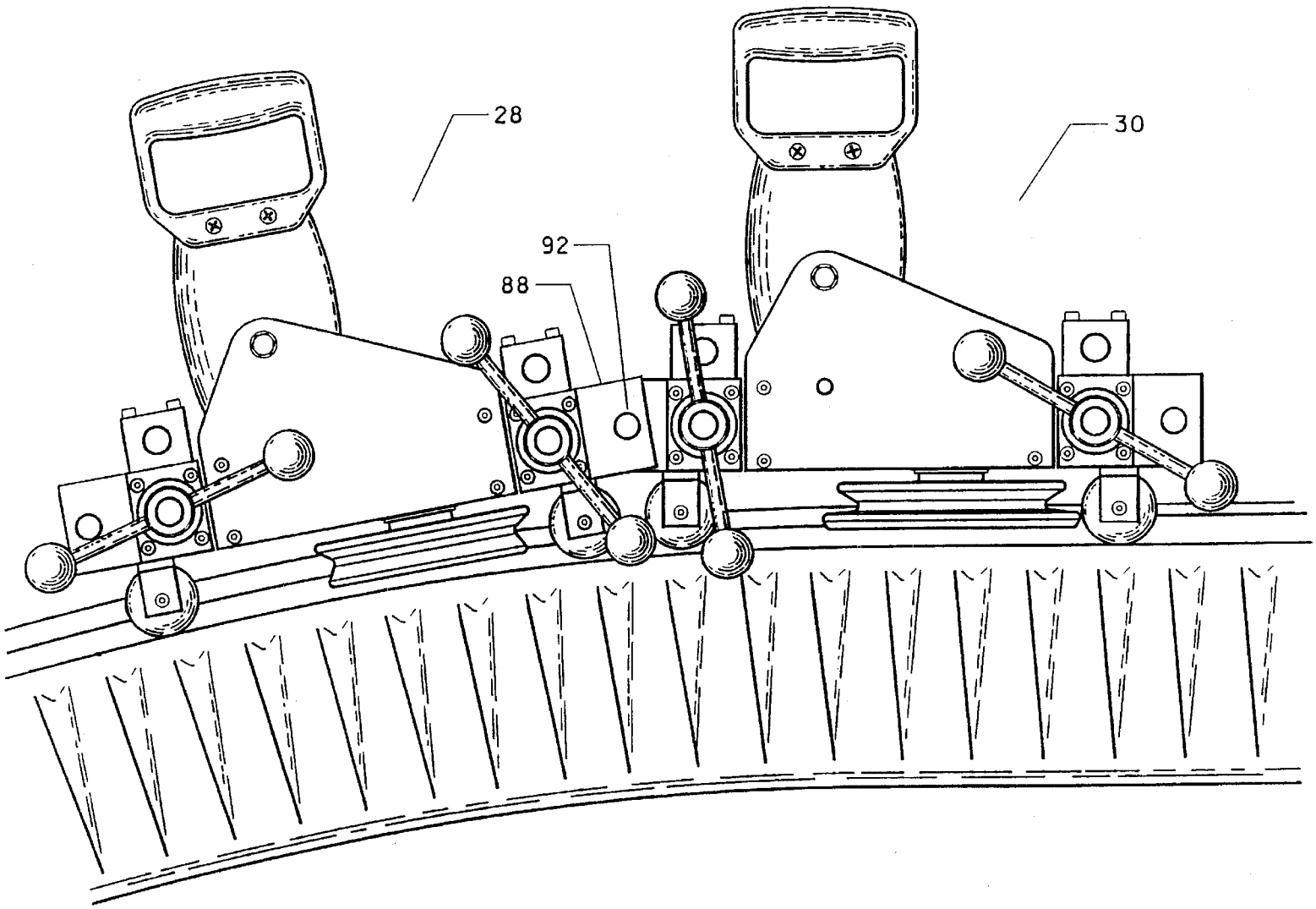
FIG. 7 is a side view of seaming apparatus joining two panels.

As can be seen in FIG. 6, pinion 63 is coupled to the end of the shaft of the electric motor 32. Pinion 63 drives gear 65 which is coupled to the same shaft as pinion 67. Pinion 67 drives gear 66 which is coupled to the shaft of the outside roller. Gear 66 drives gear 64 which is coupled to the shaft of the inside roller.

Each frame consists of two halves split along the line of travel. A first half or inside frame is generally indicated as 36 and a second half or outside frame as 39. Each half is formed from an upper plate 38 and a lower plate 40. The plates are preferably aluminum. The two plates act as the main framework for each half. The aluminum plates sandwich the gear train 34 that provides a positive drive for the horizontally opposed rollers. Aluminum plate 42 couples electric motor 32 to aluminum plates 38 and 40. Aluminum plate 42 also acts as a safety cover for the gear drive train that is sandwiched between aluminum plates 38 and 40.

Each frame (28 and 30) includes two clamping screws and two guide rods. One set of a clamping screw and guide rod is described with it being understood that the other three sets are of a similar construction. The clamping screws are used to adjust the fit of the seamer to the seam.

Aluminum block 44 contains a length of threaded rod 46 that is pinned so as to constrain any linear or rotary motion. Threaded rod 46 extends through a similar aluminum block 48 and is sandwiched by the inside roll framework 36. A thrust bearing 50 is mounted at the end of the block 48 and provides a surface for an internally threaded cylinder 52 that is threaded onto rod 46. A handle 54 is attached to the threaded cylinder and the handle 54 can be rotated to cause the threaded cylinder 52 to cooperate with the threaded rod 46 to create a clamping screw for bringing the outside frame 39 towards the inside frame 36 or for moving the two frames further apart from each other. Clamping forces created by the clamping screw are resisted by spring 56 that surrounds the threaded rod 46 between blocks 44 and 48.

Mounted on top of upper outside aluminum plate 38 is an aluminum block 58 which contains a smooth stainless steel rod 60 that is press fit into a bore into the block. Stainless steel rod 60 extends into a similar block (not shown) mounted on top of the corresponding plate of the inside frame. The stainless steel rod is slip fit into aluminum block and acts as a guide as the inside and outside frames are moved by the clamping screw. As the inside and outside frames are moved together by the clamping screw, an inside gear 64 meshes with an outside gear 66 (portions of gear drive 34) thereby coupling inside and outside gears to the motor 32.

Figure 3:
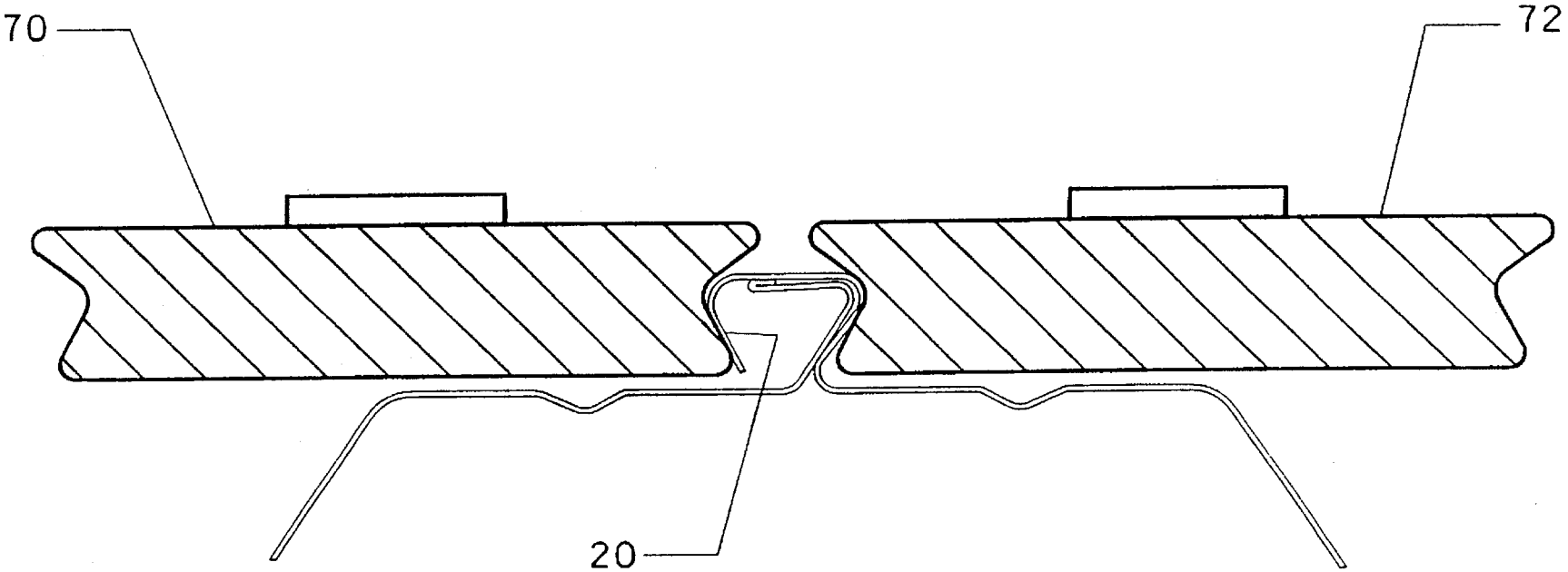
FIG. 3 is a fragmentary cut-away view showing the arrangement of a first set of rollers and the seaming process.
Figure 4:
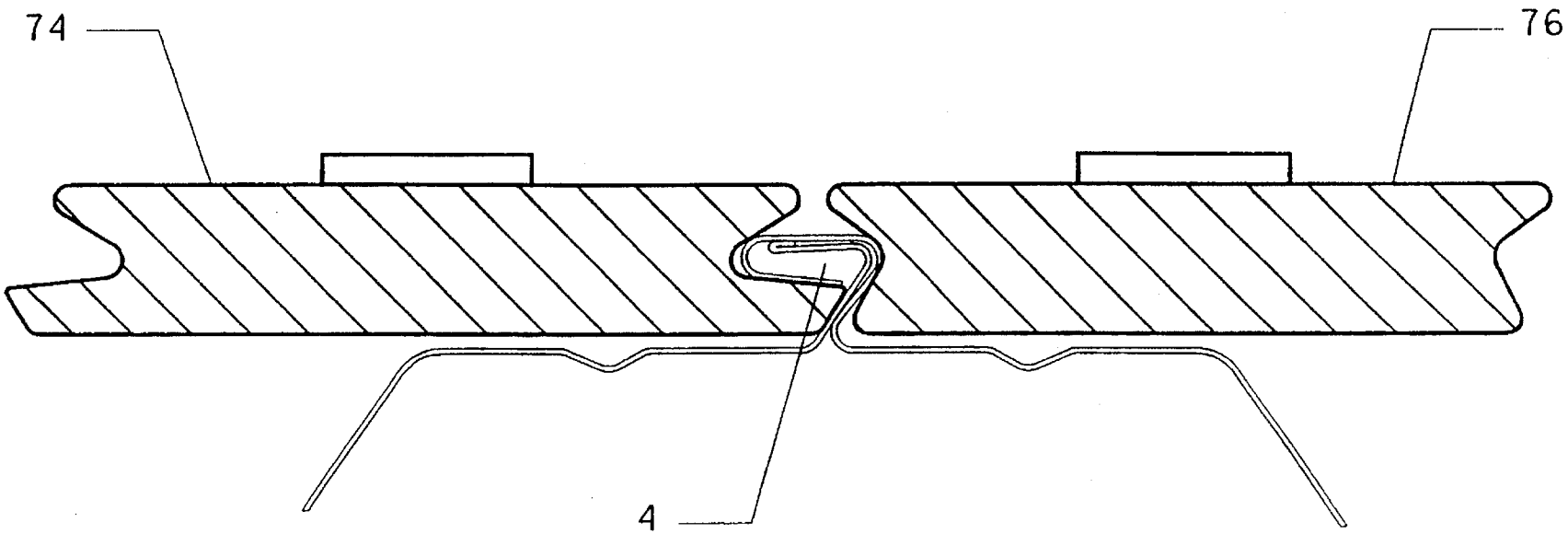
FIG. 4 is a fragmentary cut-away view showing the arrangement of a first set of rollers and the seaming process.

The seaming apparatus includes two sets of successively mounted horizontally opposed rollers. The first set or stage 1 rollers are shown in FIG. 3. The second set or stage 2 rollers are shown in FIG. 4. The stage 1 rollers include an outside roller 70 and an inside roller 72. The stage 2 rollers include an outside roller 74 and an inside roller 76. The rollers are manufactured of high strength, high hardness steel and are chrome plated to insure durability and rust proofing. The rollers are identically rotatably mounted on steel shafts 78 (see FIG. 2) that have splines at the end at which the rollers are attached. The steel shafts 78 are supported in two places by radial bearings 80 and 82. The bearings 80 and 82 are press fit into lower plate 40 and upper plate 38 respectively.

Figure 2:
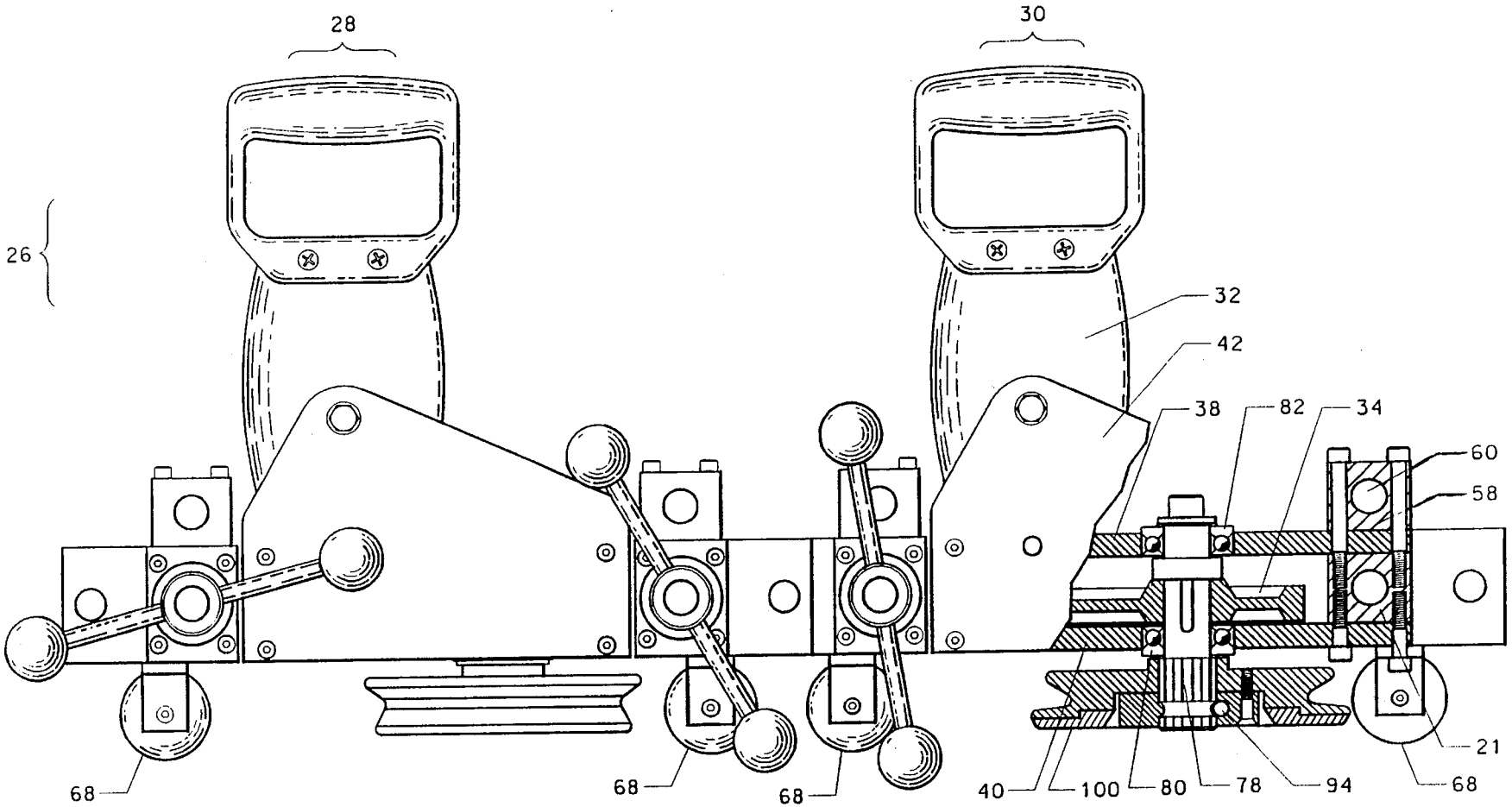
FIG. 2 is a partial cut-away side view of an embodiment of the present invention.
Figure 8:
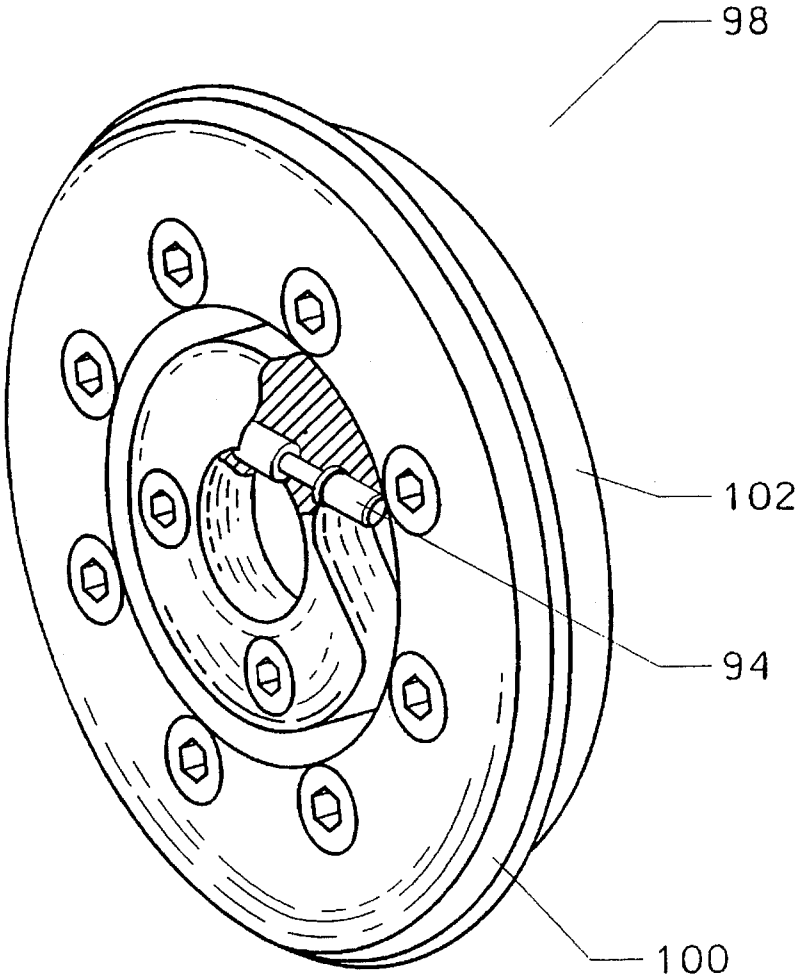
FIG. 8 is perspective view of a roller.

Alternatively, the stage 1 and stage 2 inside drive rollers are rotatably mounted using a quick release system incorporating detent slide pin 94 (FIGS. 2 and 8). When the detent pin 94 is pushed, the roller can be easily dislodged from the shaft 78. The notch in detent pin 94 allows for the free movement of the roller (e.g. 74) along the shaft when the detent pin is pressed a preset amount. In that manner the rollers can be quickly removed by the use of the quick release and swapped one for the other This feature allows the apparatus to operate in the opposite direction without removing the detent pin 92 and rearranging the two stages.

In addition, the stage 2 inside drive roller 74 shown in FIG. 4 can be replaced with a high traction inside drive roller 98 shown in FIG. 8. The high traction roller 98 incorporates a strong replaceable urethane insert 100. The urethane insert 100 is bolted directly to a modified inside drive roller 102. This roller can be used if roller traction is a problem due to wet conditions or a slippery coating on the panel. The rubber-like characteristics of the urethane provide a higher traction gripping surface than the chrome plated steel roller.

The first frame (stage 1) 28 and the second frame (stage 2) 30 are coupled together in a hinge-like manner through the cooperation of pairs of aluminum angles 88 and 90. The pairs of aluminum angles 88 and 90 include matching openings and a quick release detent pin 92 that fits through the openings and joins the two stages together. The cooperation of the quick release detent pin with the aluminum angles 88 and 90 form a hinge perpendicular to the line of travel of the seamer. The hinge allows the seamer to smoothly travel over transitions of panels from straight to smooth and vice versa. The hinge allows stage 1 and stage 2 to operate at angles independent of one another while still aiding each other in drive force.

Figure 5:
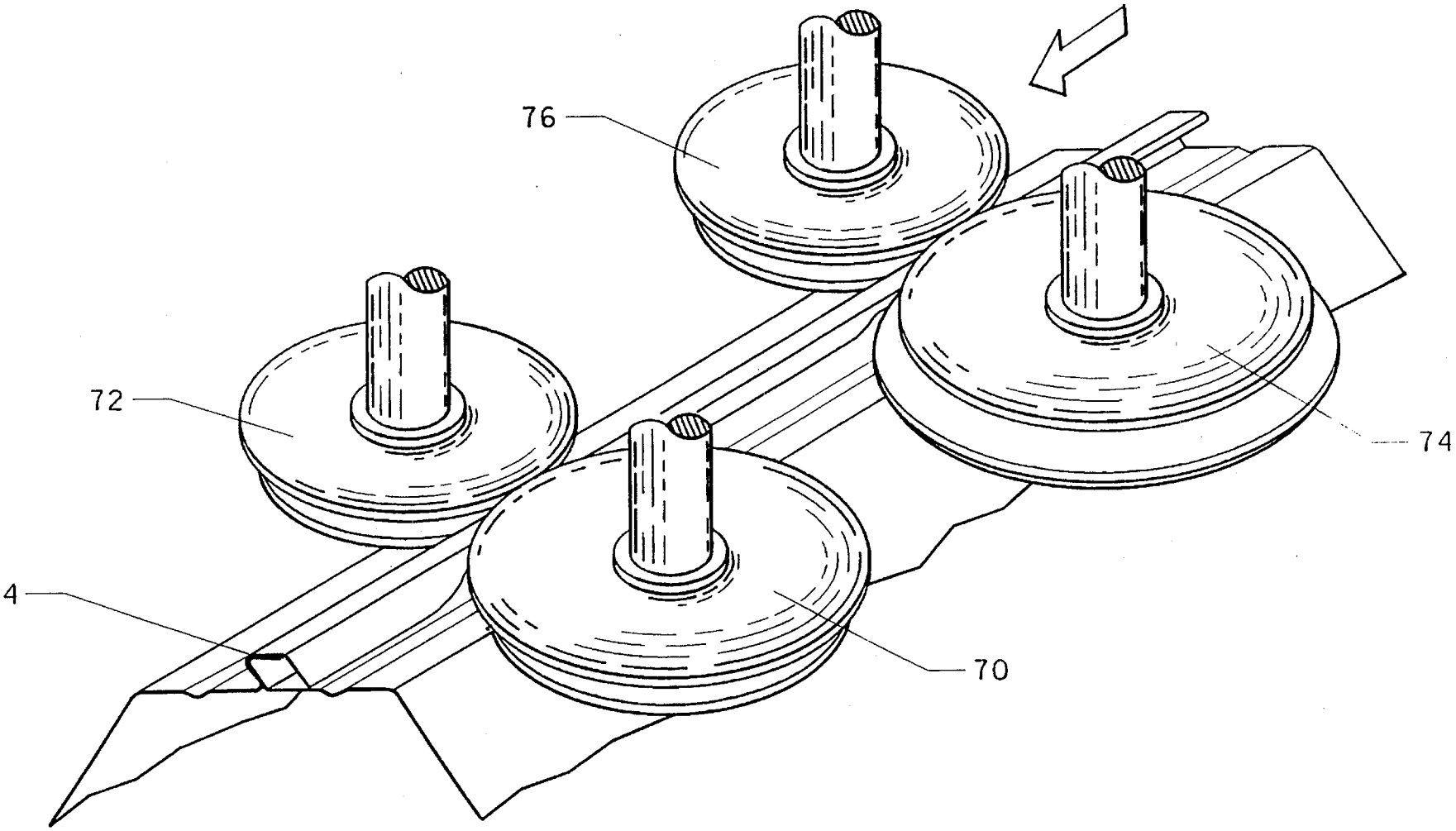
FIG. 5 is a fragmentary perspective view showing the arrangement of rollers in relation to two building panels being joined.

FIGS. 3–5 show the seam forming process. The seaming takes place as the seamer moves from right to left as indicated by the arrow in FIG. 5. The inward forward roller 70 in cooperation with its outside roller 72 forces vertical edge 20 inwards towards vertical portion 16 essentially beginning the seaming process. In addition, rollers 70 and 72 assist in driving the seamer forward along the seam as they are rotated by their electric motor. Rear inner roller 74 completes the seaming process in cooperation with rear outside roller 76 by further compressing vertical edge 20 upwards towards horizontal portion 24. The electric motors 32 which drive the rollers keep the apparatus moving forward due to the frictional contact of the rollers with the hook and hem portions of the panels.

Although the present invention has been described with a certain degree of particularity, it is to be understood that the present disclosure has been made by way of example and that changes of details of structure and operation may be made without departing from the spirit of the present invention.

What is claimed is:

1. A seaming apparatus for connecting a pair of adjacent panels by traveling along the seam at which the two panels are to be connected, one panel having an outturned flange portion with a downturned terminal portion forming a U-shaped channel and the other panel having an inturned flange portion positioned in the U-shaped channel of the one panel, said seaming apparatus comprising:

a first frame and a second frame, each of said frames including a drive motor mounted to said frame, an inside roller and an outside roller, said inside roller and said outside roller being mounted in horizontal opposition and being mounted for rotation on said frame with said inside roller capable of being positioned such that said inside roller rides over the outturned flange portion and opposite the downturned terminal portion and said outside roller is in contact with the downturned terminal portion, and with at least one of said rollers being coupled to said drive motor by a drive train; and a hinge coupling said first frame to said second frame with the hinge operating across the direction of travel of the seaming apparatus.

2. A seaming apparatus for connecting a pair of adjacent panels by traveling along the seam at which the two panels are to be connected, one panel having an outturned flange portion with a downturned terminal portion forming a U-shaped channel and the other panel having an inturned flange portion positioned in the U-shaped channel of the one panel, said seaming apparatus comprising:

a first frame including a first drive motor mounted to said first frame, an inside roller and an outside roller, said inside roller and said outside roller being mounted in horizontal opposition and being mounted for rotation on said first frame with said inside roller capable of being positioned such that said inside roller rides over the outturned flange portion and opposite the downturned terminal portion and said outside roller is in contact with the downturned terminal portion such that said outside roller bends the downturned terminal portion under the inturned terminal portion at an angle, and with at least one of said rollers being coupled to said drive motor by a drive train; and a second frame including a second drive motor mounted to said second frame, a second inside roller and a second outside roller, said second inside roller and said second outside roller being mounted in horizontal opposition and being mounted for rotation on said second frame with said second inside roller capable of being positioned such that said second inside roller rides over the outturned flange portion and opposite the downturned terminal portion and said second outside roller is in contact with the downturned terminal portion such that said second outside roller further bends the angularly disposed downturned terminal portion towards the underside of the inturned flange portion as said sets of rollers move along the panels, and with at least one of said rollers being coupled to said drive motor by a second drive train; and coupling means for coupling said first frame to said second frame.

* * * * *